United States Patent [19]

Marchio

[11] 4,079,241

[45] Mar. 14, 1978

[54] LAMP WITH STORAGE AND DISPLAY APPARATUS

[76] Inventor: Douglas R. Marchio, 2004 Knob Hill Dr., Plano, Tex. 75074

[21] Appl. No.: 698,823

[22] Filed: Jun. 23, 1976

[51] Int. Cl.[2] ..... F21V 33/00

[52] U.S. Cl. ..... 362/253; 211/130; 362/311; 362/410

[58] Field of Search ..... 240/2 AD, 2 AT, 4, 6, 240/36, 69, 78 E, 88, 89, 146; 211/85, 117, 118, 130, 132

[56] References Cited

U.S. PATENT DOCUMENTS

| | | | |
|---|---|---|---|
| 889,517 | 6/1908 | Gerken | 240/2 AD |
| 1,500,842 | 7/1924 | Paulson | 240/4 |
| 1,801,432 | 4/1931 | Johnson | 240/2 AD |
| 1,802,528 | 4/1931 | Petrolo | 240/4 |
| 2,356,688 | 8/1944 | O'Reilly | 240/2 AD |
| 2,650,150 | 8/1953 | Smith et al. | 211/130 X |
| 3,801,809 | 4/1974 | Slade | 240/4 X |
| 3,847,285 | 11/1974 | Leprince | 240/2 AD X |
| 3,911,267 | 10/1975 | Kiehn | 240/69 X |
| 3,950,637 | 4/1976 | Rodin | 240/78 E X |
| 3,963,913 | 6/1976 | Donovan et al. | 240/2 AD |

*Primary Examiner*—Edna M. O'Connor

*Attorney, Agent, or Firm*—Limbach, Limbach & Sutton

[57] ABSTRACT

A lamp for illuminating, storing and displaying small objects is disclosed and includes at least one tray for supporting the small objects and means for supporting the tray selectively in either a position nesting adjacent a tray receiving means or a position spaced below the tray receiving means.

14 Claims, 9 Drawing Figures

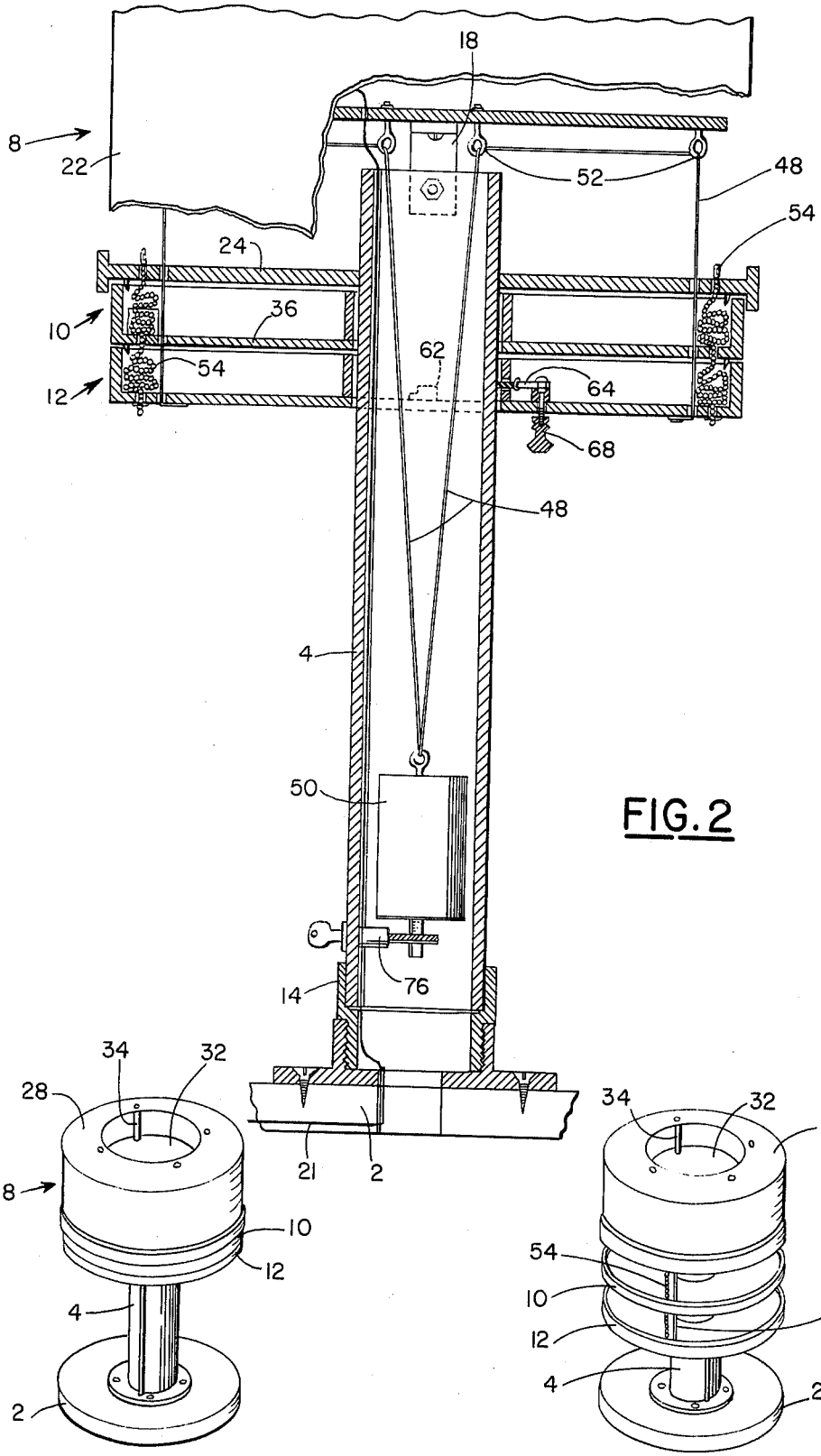
FIG. 2
FIG. 3
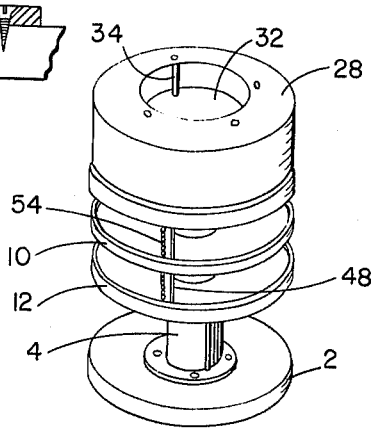
FIG. 4

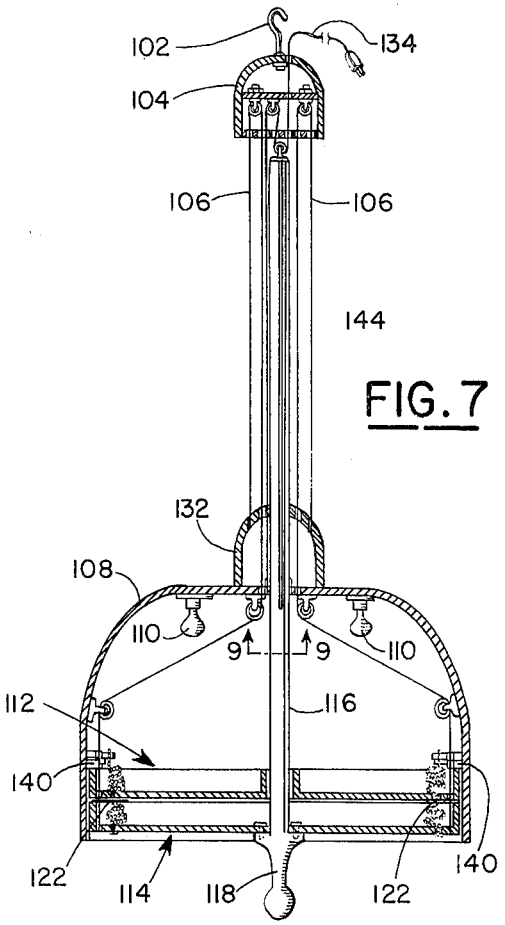
FIG. 7
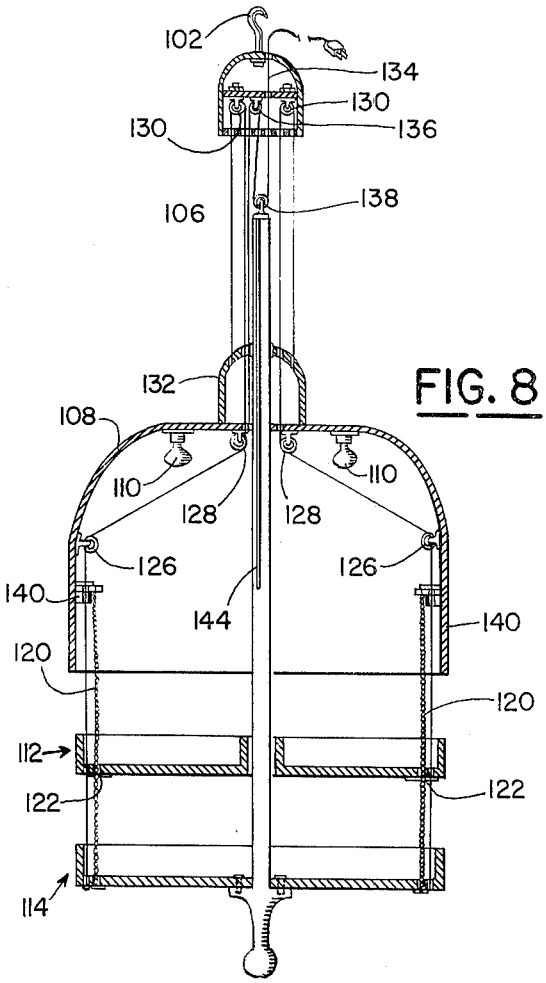
FIG. 8
FIG. 5
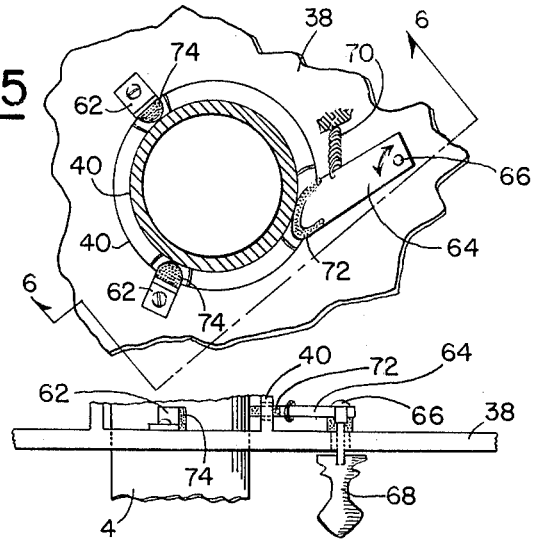
FIG. 6
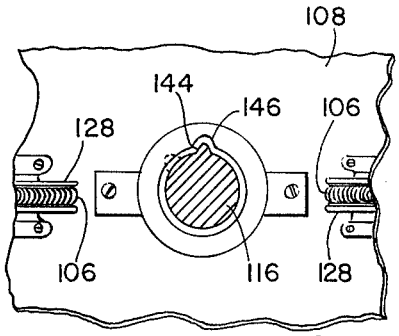
FIG. 9

LAMP WITH STORAGE AND DISPLAY APPARATUS

BACKGROND OF THE INVENTION

This invention is directed toward the field of illuminating lamps. More particularly, it is directed toward lamps for room illumination which include structure for storage of small objects.

Two items commonly needed and found in rooms such as bedrooms and boudoirs are lamps, either free-standing or suspended, and storage receptacles for small objects, such as jewelry. While, in many cases there may be ample space on a dresser for both a table lamp and a conventional jewelry box, the presence of two such bulky items is frequently inconvenient, especially where dresser space is limited. Such space limitations frequently require the placement of such storage receptacles either in a drawer or in a closet, thus making their access inconvenient. Additionally, space limitations may require the placement of such storage receptacles remote from lamps and other light sources, thus making the location of specific desired objects in the receptacle an inconvenient matter of searching through cramped spaces in poor light. Yet another problem associated with the independent storage receptacle, such as jewelry box, is that it may easily be located by a thief, and, by virtue of its convenient size and configuration, may easily be carried off, thus resulting in a potential loss of an entire collection of valuable objects.

SUMMARY OF THE INVENTION

In response to the above problems, it is an object of this invention to provide a lamp including a convenient means for storing, illuminating and displaying small objects. It is a further object of the invention to provide such a lamp which includes means for inconspicuous storage of such objects while providing for their convenient access.

Briefly, the invention contemplates a lamp including means for illuminating, storing and displaying small objects comprising a light source, lamp support means, at least one tray for supporting the small objects, means attached to the lamp support means and spaced from the light source for nestably receiving the tray, and means for supporting the tray selectively in either a position nesting adjacent the tray receiving means or positioned spaced below the tray receiving means.

BRIEF DESCRIPTION OF THE DRAWINGS

FIG. 2 is a fragmentary side view, partially in section, of the lamp of FIG. 1 with the storage trays in the closed position;

FIGS. 3 and 4 are perspective views on a smaller scale of the lamp of FIG. 1 with the storage trays in the closed and open positions, respectively;

FIG. 5 is a fragmentary view of a portion of the lamp of FIG. 1, taken on lines 5—5;

FIG. 6 is a side view of the fragmentary view of FIG. 5, taken along lines 6—6;

FIG. 7 is a side sectional view taken through the center of a second embodiment of the lamp of this invention, with the storage trays in the closed position;

FIG. 8 is a side sectional view of the lamp of FIG. 7 with the storage trays in the open position; and FIG. 9 is a fragmentary sectional view of the lamp of FIG. 7 taken along line 9—9.

DESCRIPTION OF PREFERRED EMBODIMENTS

Figure 1:
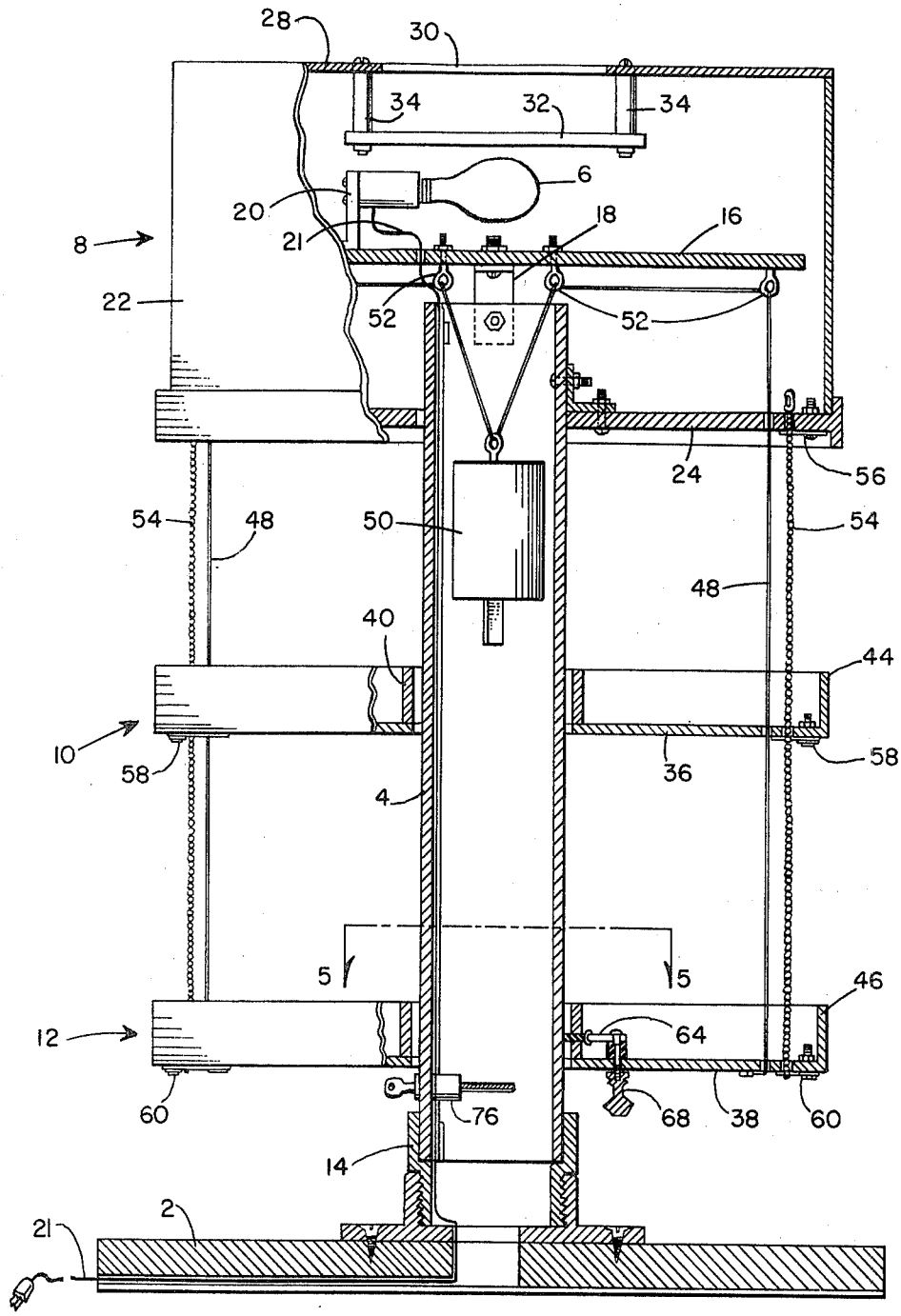
FIG. 1 is a side elevation, partially in section, of one preferred embodiment of the lamp of this invention with the storage trays in the open position.

One preferred embodiment of the lamp of this invention, in the form of a table lamp, is illustrated in FIGS. 1 through 6. In this embodiment, the basic components of the lamp include a base 2, an upright support member 4 attached to the base, a light source 6 supported by the post 4, a lamp shade 8 which is spaced from the light source, and a plurality of trays 10 and 12 suspended from the lamp.

As illustrated in FIG. 1, the upright support 4 of this embodiment preferably is a hollow tube, suitably of metal or a translucent acrylic material, affixed to the base 2 by suitable fittings 14. A flat plate 16, suitably of a transparent or translucent acrylic material, is attached to the top of upright 4 by means of one or more brackets 18. The light source 6, which conveniently may be an incandescent bulb, is attached to this plate 16 by means of a bracket 20, with the wiring 21 for the light source running down through the upright 4 and base 2.

Lamp shade 8 conveniently may be of a generally cylindrical configuration with the cylindrical portion 22 suitably of a translucent acrylic material surrounding and spaced horizontally from the light source 6. The cylindrical portion 22 conveniently may be bonded to a disc-like lower plate 24, suitably of transparent acrylic material and which is attached to upright 4 by means of one or more brackets 26. The top of shade 8 conveniently may comprise an annular disc-like member 28, conveniently of translucent acrylic material, and bonded to the upper portion of cylindrical portion 22. This top portion 28 preferably includes a centrally disposed cooling aperture 30. To diffuse the light from bulb 6 and to reflect it downwardly, a reflector 32, suitably of a shiny metal, is affixed to top plate 28 and spaced downwardly therefrom by a plurality of spacers 34, thus effecting a light baffle below the cooling aperture 30.

While the foregoing describes the apparatus associated with the lamp of this invention as a table lamp, one of the great benefits of this invention lies in its capability for storing and securing small objects in the adjustably positionable trays 10 and 12. As is indicated in FIGS. 1, 2 and 4, the trays of this preferred embodiment are of generally annular configuration, surrounding lamp upright 4. While two trays, 10 and 12, are illustrated, the number of trays included is obviously a matter of choice, and the principles of the invention would apply equally with a single tray or any convenient number of trays. In the illustrated embodiment, the trays 10 and 12 suitably may be formed of a rigid synthetic resin material. The trays 10 and 12 suitably comprise annular, disc-like bases 36 and 38. The base 36 of the upper tray preferably is of transparent material to admit light therethrough, while the base 38 of the lower tray may be partially transparent but is preferablly of opaque or translucent material to prevent viewing of the contents within. Extending upwardly from these bases 36 and 38 are cylindrical guide collars 40 and 42, respectively, for guiding movement of the trays vertically along upright 4 of the lamp. Extending upwardly about the outer periphery of the tray bases 36 and 38 are circumferential walls 44 and 46, which preferably are of translucent or opaque material to prevent direct viewing of the contents inside when the trays are in the position illustrated in FIG. 2.

As illustrated in FIGS. 1 through 4, the trays may be positioned in either a closed position nestably received adjacent the lower portion of the shade (FIGS. 2 and 3) or in an open position spaced below the shade (FIGS. 1 and 4). In the sectional views of FIGS. 1 and 2 is illustrated the apparatus for supporting the trays in these positions. As noted above, the trays 10 and 12 include annular collars 40 and 42, respectively, for guiding the movement of the trays vertically along the upright 4. The lower tray 12, which could be the only tray of the lamp if desired, is supported by a counterbalance arrangement including a pluraity (suitably three or four) of suspension strings 48, each affixed at one end to lower tray 38 and at the opposite end to counterweight 50. These suspension strings 48 may suitably be of nylon or similar material. The counterweight 50, movable vertically within lamp upright 4, desirably is of a weight sufficient to counterbalance the weight of all trays included with the lamp and the weight of a reasonable quantity of objects stored within. Thus, the force exerted by counterweight 50 on the suspension strings 48, acting through eyelet guides 52, serves to urges the lower tray 12, and, thus the upper tray 10 nested with tray 12, into the position illustrated in FIGS. 2 and 3, with both trays nestably received adjacent the lower portion of the shade 8.

To support the upper tray 10 in its desired position, illustrated in FIGS. 1 and 4, spaced above lower tray 12 and below the shade 8, additional supporting means, suitably in the form of flexible beaded chains 54 are provided with clips 56 attaching the upper ends of the chain to the lower plate 24 of the shade, clips 58 attaching tray 10 to the chain 54 at an intermediate position along the chain and clips 60 attaching lower tray 12 to the lowermost extremity of the extended chain as shown in FIG. 1. Thus, when the trays are lowered from their nested position (FIG. 2) the upper tray 10 will be stopped in its downward movement when the portion of the chains 54 between clips 56 and 58 becomes taut, while the lower tray 12 may continue its descent until the portion of the chains 54 between clips 58 and 60 becomes taut.

Since, as noted above, counterweight 50 is of sufficient weight to counterbalance both trays 10 and 12 and their contents, it is also necessary to provide some brake means for selectively and releasably holding the lower tray in its lowermost position, or in any other desired position along upright 4. This brake, shown in FIGS. 1 and 2 is illustrated in more detail in the fragmentary views of FIGS. 5 and 6. A pair of tabs 62, suitably spaced about 120° apart, project through the collar 42, as shown in FIG. 5. Positioned about 120° from each of these tabs 62 is a releasable brake arm 64 pivotally mounted to the base 38 of tray 12 by means of shaft 66 projecting therethrough. The shaft is received into knob 68, which provides for pivotal movement of the arm 64 in the direction indicated by the arrows, into and out of engagement with the lamp upright 4. A spring 70 urges the arm 64 into such engagement. To enhance the frictional engagement of both the tabs 62 and the arm 64, the portions of those items contacting the upright 4 are covered with tips 72 and 74 of a material having a high coefficient of friction, such as soft rubber or synthetic resin. Thus, when the knob 68 is released, the spring 70 urging the arm 64 into contact with the upright 4 will effect frictional gripping of the upright 4 by tabs 62 as well as arm 64, thus holding the lower tray 12 in its selected position.

To secure the trays and their contents against unauthorized tampering when the trays are in their closed position nested against the lower portion of the shade 8, a conventonal key operated lock 76 is provided in the lower portion of the upright 4 for releasably engaging and locking the counterweight 50 in its lowermost position, thus locking the trays in their closed, nested position against the lower portion of the lamp shade, as shown in FIGS. 2 and 3.

From the foregoing it may be seen that the operation of the lamp of this embodiment is as follows: When the lock 76 is released and the brake arm 64 rotated out of engagement with the lamp upright 4, the user may then lower trays 10 and 12 from their position nested against the lamp shade 8. Upon reaching the predetermined distance, the descent of upper tray 10 will be arrested by the stop chain 54, thus exposing the contents of tray 10 for access. At this point, the descent of tray 12 may either be stopped, leaving it closed against the bottom of tray 10, or may be continued to expose the contents of tray 12. When tray 12 has been lowered to its desired position, the brake knob 68 may be released, permitting the spring biased engagement of the brake structure against the upright, thus holding tray 12 in that selected position. By virtue of the transparent base 36 of tray 10, light from light source 6 may shine through tray 10 and illuminate the contents of tray 12. When access to the contents of the trays is no longer required, the brake arm 64 may again be taken out of engagement with the lamp upright 4 and the trays raised with the assistance of counterweight 50 to their closed position nested against the lower portion of the lamp shade 8. At this point the lock 76 may be re-engaged, thus preventing any further unauthorized access to the contents of the trays. By virtue of the translucent or opaque portions of the trays 10 and 12 the contents of those trays are effectively hidden from view.

A second desirable embodiment of the lamp of this invention, suitable for suspension from a ceiling, is illustrated in FIGS. 7 through 9. The basic components of this lamp are the lamp supporting hanging hook 102, upper housing 104, suspension strings or cables 106, lamp shade 108, light sources 110, trays 112 and 114, and upright 116. In addition to the hanging arrangement, one of the significant differences between this embodiment and the previously described embodiment, is the use here of the lamp shade 108 as the counterbalance weight. Since the lamp of this embodiment may desirably also be circular and generally axi-symmetric, only a side sectional view taken generally along the axis of symmetry is shown.

In this embodiment tray 114 is rigidly affixed to the lowermost portion of upright 116 which terminates in handle 118. As with the previous embodiment, the trays 112 and 114 are attached to the lamp shade 108 by stop chains 120, with upper tray 112 being attached at an intermediate position along the chain by means of clips 122. Also as with the previous embodiment the lower tray 114 is attached to the counterbalance weight (shade 108) by a plurality of suspension strings 106. These suspension strings, which conveniently may be of nylon strings, extend from lower tray 114, through pulleys 126 and 128 attached to the shade 108 around pulleys 130 affixed to the upper housing 104, and back to the upper portion 132 of shade 108. Such an arrangement provides for simultaneous raising of the shade, as illustrated in FIG. 8, as the trays 112 and 114 are lowered by a downward pull on handle 118, by virtue of the pulley and string arrangement. Similarly, lamp cord 134 is routed upwardly from the shade, over pulley 136 affixed to upper housing 104, around pulley 138 affixed to the top of upright 116 and out an aperture in the upper housing 104. By virtue of this pulley arrangement, the total included lengths of both the lamp cord 134 and the suspension strings 106 remain constant within the lamp structure as the trays are raised and lowered.

The trays 112 and 114 are of construction generally similar to that of the previously described embodiment and, as illustrated in FIG. 7, are nestably received adjacent the lower portion of the shade 108 when in their raised, closed position. In this position, the lower tray 114 nests with and abuts upper tray 112, the upper portion of the outer rim of upper tray 112 abuts the bottom of blocks 140 affixed to the shade, which also serve to guide suspension strings 106.

It may be noted that a different type of brake structure is conveniently used with the lamp of this embodiment, as illustrated in FIG. 9. The brake structure comprises a soft rubber ring 142 affixed to shade 108 and surrounding the aperture through which upright shaft 116 passes. The shaft 116 is provided with a longitudinally extending projecting rib 144 which may be aligned selectively either within a notch 146 provided in rubber ring 142 (solid line representation of FIG. 9) or, by selective rotation of shaft 116, may be caused to engage interferingly with another portion of rubber ring 142 (broken line representation of FIG. 9). Thus, when the rib 144 of shaft 166 is aligned with notch 146, the shaft may be freely moved longitudinally with respect to shade 108. However, when the shaft 116 is rotated to one of its interferingly engaging positions with respect to ring 142, relative longitudinal movement between shaft 116 and shade 108 is frictionally restrained, thus providing the desired braking force to hold the lamp in its open position, as illustrated in FIG. 8.

While the foregoing illustrative embodiments represent two desired embodiments of the principles of this invention, it is to be recognized that they represent only two of many possible such embodiments, all of which may incorporate the principles of this invention. Such other embodiments may incorporate any number and any configuration of trays, other types of lighting sources, various types of suspension systems, manually operated and motor driven, various types of brakes, and other types of materials for components. Accordingly, since all such variations incorporating the principles of this invention are considered to be within the scope of the invention, this invention is to be limited not by the foregoing illustrative embodiments but solely by the claims appended hereto.

What is claimed is:

1. A lamp including means for illuminating, storing and displaying small objects, comprising a light source;

lamp support means, at least one tray for supporting said small objects, means attached to said lamp support means and spaced from said light source for nestably receiving said tray, and means for supporting said tray selectively in either a position nesting adjacent said tray receiving means or a position spaced below said tray receiving means.

2. A lamp according to claim 1 wherein said tray supporting means comprises means for adjustably supporting said tray in any selected one of a plurality of positions spaced below said tray receiving means.

3. A lamp according to claim 2 further comprising brake means for selectively and releasably holding said tray in any selected one of said positions.

4. A lamp according to claim 1 wherein said tray supporting means further comprises means for urging said tray upwardly into said nesting position.

5. A lamp according to claim 1 further comprising means for releasably locking said tray in said nesting position against said tray receiving means.

6. A lamp according to claim 1 wherein said tray is at least partially transparent, whereby light from said light source may shine therethrough.

7. A lamp according to claim 1 wherein said tray receiving means comprises a portion of a shade for said lamp.

8. A lamp according to claim 1 further comprising tray guiding means for guiding movement of said tray between said nested position and said spaced position.

9. A lamp according to claim 8 wherein said tray receiving means is movable along said tray guiding means in a direction generally opposite said movement of said tray, and wherein said tray receiving means is connected to said tray to serve as a counterbalance to said tray, whereby downward movement of the tray serves to move the tray receiving means upwardly.

10. A lamp according to claim 9 wherein said light source is attached to said tray receiving means for movement with said tray receiving means.

11. A lamp according to claim 1 further comprising a plurality of said trays each vertically nestable adjacent the tray above, with the uppermost said tray nestable adjacent said tray receiving means.

12. A lamp according to claim 11 wherein each said tray above the lowermost said tray is at least partially transparent, whereby light from said light source may shine through those upper trays to illuminate the lowermost tray.

13. A lamp according to claim 11 wherein said tray supporting means further comprises means for supporting said trays selectively either nested together adjacent said tray receiving means or spaced below said tray receiving means.

14. A lamp according to claim 13 wherein said tray supporting means further comprises means for limiting to predetermined distances the maximum spacing between each said tray and the tray immediately above and between the uppermost said tray and said tray receiving means when said trays are supported spaced below said tray receiving means.

* * * * *